US007885595B2

(12) United States Patent
Ninomiya et al.

(10) Patent No.: US 7,885,595 B2
(45) Date of Patent: Feb. 8, 2011

(54) LUBRICANT APPLICATOR, PROCESS CARTRIDGE INCLUDING SAME, AND IMAGE FORMING APPARATUS INCLUDING SAME

(75) Inventors: Hiromichi Ninomiya, Yokohama (JP); Takaaki Tawada, Yokohama (JP); Takatsugu Fujishiro, Tokyo (JP); Akira Fujimori, Fujisawa (JP)

(73) Assignee: Ricoh Company Limited, Tokyo (JP)

( * ) Notice: Subject to any disclaimer, the term of this patent is extended or adjusted under 35 U.S.C. 154(b) by 153 days.

(21) Appl. No.: 12/203,631

(22) Filed: Sep. 3, 2008

(65) Prior Publication Data

US 2009/0060600 A1 Mar. 5, 2009

(30) Foreign Application Priority Data

Sep. 4, 2007 (JP) ..... 2007-228729
Nov. 27, 2007 (JP) ..... 2007-305555
Apr. 28, 2008 (JP) ..... 2008-116872

(51) Int. Cl.
*G03G 21/00* (2006.01)

(52) U.S. Cl. ..... 399/346

(58) Field of Classification Search ..... 399/98, 399/346, 350, 358

See application file for complete search history.

(56) References Cited

U.S. PATENT DOCUMENTS 5,589,924 A * 12/1996 Yano et al. ..... 399/346
7,035,582 B2 4/2006 Suda et al.
7,120,376 B2 * 10/2006 Saito et al. ..... 399/350
7,149,465 B2 12/2006 Amemiya et al.
7,209,698 B2 4/2007 Tawada et al.
7,292,816 B2 11/2007 Ojimi et al.
7,313,347 B2 12/2007 Shintani et al.
7,373,101 B2 5/2008 Hozumi et al.
7,376,380 B2 5/2008 Koike et al.
7,391,991 B2 6/2008 Suda et al.
2007/0003336 A1 1/2007 Ninomiya et al.
2007/0036595 A1 2/2007 Amemiya et al.
2007/0059067 A1 3/2007 Tanaka et al.
2007/0092315 A1 * 4/2007 Koyama ..... 399/358
2007/0183824 A1 8/2007 Suda et al.
2007/0258743 A1 11/2007 Shakuto et al.
2008/0013998 A1 1/2008 Kumagai et al.
2008/0181689 A1 7/2008 Fujimori

FOREIGN PATENT DOCUMENTS

JP 2000-172119 6/2000
JP 2004-251940 9/2004
JP 2006-163318 6/2006
JP 2007-86321 4/2007

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

A lubricant applicator, which is included in a process cartridge, and an image forming apparatus, includes a fur brush disposed downstream from a cleaning member in a direction of rotation of the image carrier that moves in the direction of rotation of the image carrier, scrape a solid lubricant disposed opposite to the image carrier while rotating, and apply powder scraped from the solid lubricant to the surface of the image carrier; a lubricant fixing member to fix the powder to the surface of the image carrier; and a first guide member disposed between the lubricant fixing member and the fur brush to convey the powder scattered from the fur brush to the surface of the image carrier.

20 Claims, 7 Drawing Sheets

LUBRICANT APPLICATOR, PROCESS CARTRIDGE INCLUDING SAME, AND IMAGE FORMING APPARATUS INCLUDING SAME

CROSS-REFERENCE TO RELATED APPLICATIONS

The present invention claims priority pursuant to 35 U.S.C. §119 from Japanese Patent Application Nos. 2007-228729, filed on Sep. 4, 2007 in the Japan Patent Office; 2007-305555, filed on Nov. 27, 2007 in the Japan Patent Office; and 2008-116872, filed on Apr. 28, 2008 in the Japan Patent Office, the contents and disclosures of each of which are hereby incorporated by reference herein in their entirety.

BACKGROUND OF THE INVENTION

1. Field of the Invention

Exemplary embodiments of the present invention generally relate to a lubricant applicator, a process cartridge, and an image forming apparatus, and more particularly, to a lubricant applicator that performs electrophotographic image forming processes, a process cartridge that includes the lubricant applicator, and an image forming apparatus that includes the lubricant applicator.

2. Discussion of the Related Art

Related-art electrophotographic image forming apparatuses include copiers, printers, facsimile machines, and multi-functional machines including functions of the copier, printer, facsimile machine, etc. Such electrophotographic image forming apparatuses form a toner image on a photoconductor or an image carrier by repeatedly conducting image forming processes, namely: Uniformly charging the photoconductor, optically writing an electrostatic latent image on a charged surface of the photoconductor, developing the latent image to the toner image, transferring the toner image onto a recording medium (for example, a transfer sheet and a sheet-like film used for overhead projector or OHP film) directly or via an intermediate transfer member, and cleaning the surface of the photoconductor.

Such electrophotographic image forming apparatuses include a lubricant applicator to apply lubricating agent or lubricant over a surface of a photoconductor. Generally, the lubricant is applied to the photoconductor by means of a rotary brush member or brush roller. When the brush roller is used, the brush roller scrapes the lubricant, and some lubricating powder scraped from the lubricant may remain on or be carried by bristles of the brush roller while some other lubricating powder may be scattered around the brush roller. The scattered lubricating powder can cause a reduction of efficiency for applying the lubricant to the photoconductor.

One attempt to increase the efficiency of lubricant application of the lubricant in powder form is to scatter residual lubricating powder attached to the brush roller so as to clean the brush roller. It is, however, difficult to estimate where the residual lubricating powder lands or adheres when scattered from the fur brush roller. This random scattering of lubricating powder can contaminate the interior of the lubricant applicator, resulting in the production of defective images.

Another approach is to try to prevent adhesion of residual toner to the brush roller. However, the brush roller can still scatter the lubricating powder. Since where the lubricating powder scatters and lands is unpredictable, it is also difficult to estimate a landing place of the scattered lubricating powder with this approach as well. Consequently, the problem of contamination of the interior of the lubricant applicator and/or production of defective images remains can be caused.

SUMMARY OF THE INVENTION

In light of forgoing, the inventor of the present invention proposes to provide, in at least one embodiment, a lubricant applicator, a process cartridge including the lubricant applicator, and an image forming apparatus including the lubricant applicator.

Exemplary aspects of the present invention have been made in view of the above-described circumstances.

Exemplary aspects of the present invention provide a lubricant applicator that can effectively convey and fix lubricating powder scraped by a fur brush to a surface of an image carrier to increase lubricant application efficiency to reduce a consumption of lubricant and maintain a stable quality in lubricant application.

Other exemplary aspects of the present invention provide a process cartridge that can include the above-described lubricant applicator.

Other exemplary aspects of the present invention provide an image forming apparatus that can include the above-described lubricant applicator.

In at least one exemplary embodiment of the present invention, a lubricant applicator includes a fur brush disposed downstream from the cleaning member in a direction of rotation of the image carrier and configured to move in the direction of rotation of the image carrier, scrape a solid lubricant disposed opposite to the image carrier as the fur brush rotates, and apply lubricating powder scraped from the solid lubricant to the surface of the image carrier, a lubricant fixing member configured to fix the lubricating powder to the surface of the image carrier, and a first guide member disposed between the lubricant fixing member and the fur brush and configured to convey the lubricating powder scattered from the fur brush to the surface of the image carrier.

The lubricant fixing member may include an elastic blade configured to contact the image carrier against to the direction of rotation of the image carrier.

One side of the first guide member may have a curved portion having a circular-arc cross-section. An inner surface of the curved portion of the first guide member may face a surface of the fur brush. A distance between a starting point of the curved portion of the first guide member and the surface of the image carrier may be greater than a distance between a point of contact between the solid lubricant and the fur brush and the surface of the image carrier. A gap formed between the inner surface of the curved portion of the first guide member and the surface of the fur brush may become narrower as the curved portion of the first guide member extends toward the image carrier.

The solid lubricant may have a square-shaped cross-section with four surfaces, one of which being a contact surface contacting the fur brush. The contact surface disposed so as to intersect a line perpendicular to a line connecting an axial center of the image carrier, an axial center of the fur brush, and a point of contact between the solid lubricant and the fur brush at an angle ranging from 1 degree to 90 degrees in the direction of rotation of the image carrier.

The above-described lubricant applicator further includes a second guide member disposed between the cleaning member and the fur brush to return the lubricating powder scattered from the fur brush to the fur brush.

The lubricant fixing member may include a coated blade.

The first guide member may have a curved portion having a circular-arc cross-section, and the curved portion of the first guide member may be concentric with the fur brush. A gap formed between an inner surface of the curved portion of the first guide member and the fur brush may be equal to or smaller than 1 mm.

The first guide member having the circular-arc cross-section may include either a protrusion or a groove along the curved inner surface thereof.

The first guide member may have a curved portion having a circular-arc cross-section. A gap formed between an inner surface of the curved portion of the first guide member and the fur brush may be no greater than 1 mm.

The solid lubricant may have a square-shaped cross-section with four surfaces, one of which being a contact surface contacting the fur brush. A center in a width direction of the contact surface may be offset to an upstream side of the direction of rotation of the fur brush from a line starting from a center of rotation of the fur brush and extending perpendicular to the contact surface.

The above-described lubricant applicator may further include a powder collector configured to collect, from the fur brush, toner removed from the surface of the image carrier before the toner reaches a point of contact between the fur brush and the solid lubricant.

The powder collector may contact the solid lubricant to restrain movement of the solid lubricant in a contact direction.

The first guide member may include a plating member holding an elastic blade.

An inner surface of the first guide member and the fur brush form a gap having different distances in a longitudinal direction of the first guide member.

The first guide member may have a curved portion having a circular-arc cross-section and the curved portion of the first guide member is concentric with the fur brush. The gap formed between the inner surface of the curved portion of the first guide member and the fur brush may be equal to or smaller than 1 mm.

The first guide member may have a curved portion having a circular-arc cross-section. A distance of the gap formed gaps formed between the inner surface of the curved portion of the first guide member and the fur brush may be no greater than 1 mm.

The above-described lubricant applicator may be included in a cleaning unit. The cleaning unit may further include a cleaning member configured to remove residual toner from a surface of an image carrier after a toner image is transferred from the image carrier.

In the above-described cleaning unit, the image carrier may be rotated by a drive motor in a given direction during a printing operation. The drive motor may cause the image carrier to rotate less than one cycle of rotation in a direction opposite to the given direction to prevent curling of the cleaning member and the lubricant fixing member after completion of the printing operation and halting of the drive motor.

Further, in at least one embodiment of the present invention, a process cartridge detachably attached to an image forming apparatus includes an image carrier configured to carry an image on a surface thereof, and the above-described lubricant applicator integrally attached thereto with the image carrier.

Further, in at least one embodiment of the present invention, an image forming apparatus that includes the above-described lubricant applicator.

BRIEF DESCRIPTION OF THE DRAWINGS

The accompanying drawings are intended to depict example embodiments of the present patent application and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
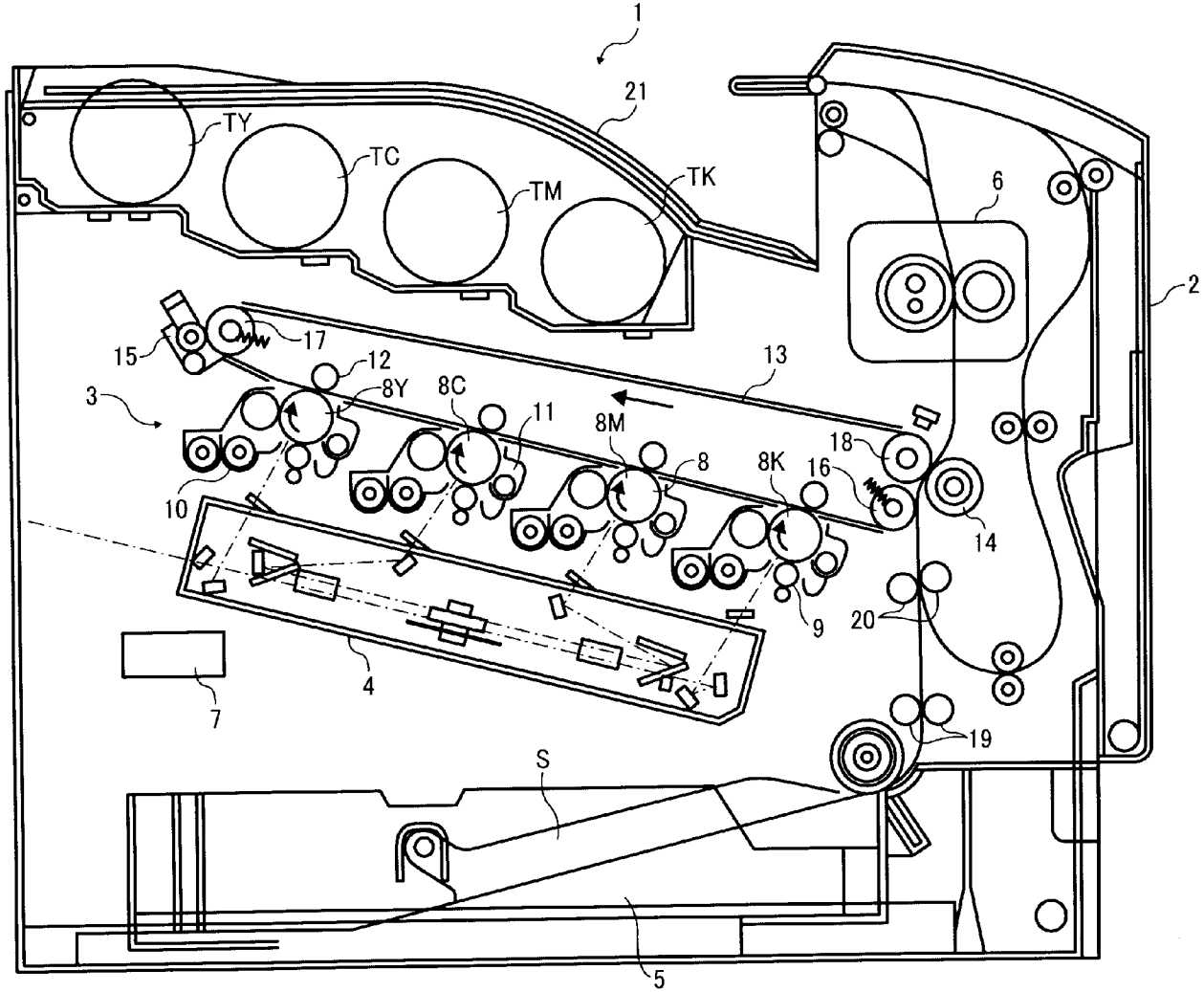
FIG. 1 is a cross-sectional view of a schematic configuration of a color printer according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Exemplary embodiments of the present invention are described below with reference to the accompanying drawings. The present invention may apply to a lubricant applicator, a cleaning unit, a process cartridge, and an image forming apparatus such as a copier, printer, facsimile machine, plotter, multifunctional apparatus including functions of at least one of the copier, printer, facsimile machine, and plotter, and so forth.

FIG. 1 is a cross sectional view of a schematic configuration of a color printer 1.

The color printer 1 serves as an image forming apparatus and includes a main body 2. The main body 2 of the color printer 1 includes an image forming mechanism 3, an optical writing unit 4, a sheet feeding cassette 5, a fixing unit 6, and a wasted toner container 7.

The optical writing unit 4 emits a laser light beam.

The sheet feeding cassette 5 serves as a recording media container to accommodate recording media including a recording sheet S.

The fixing unit 6 fixes a toner image to the recording sheet S.

The wasted toner container 7 contains wasted toner collected after the toner image is transferred from one member onto another.

The image forming mechanism 3 includes four photoconductors 8Y, 8C, 8M, and 8K, which serve as image carrier to form respective toner images before transferring the toner images onto the recording sheet S. The photoconductors 8Y, 8C, 8M, and 8K have structures identical to each other, except for colors of toners, which are yellow, cyan, magenta, and black toners conveyed respectively from toner bottles TY, TC, TM, and TK in FIG. 1. Therefore, the suffixes, "Y", "C", "M", and "K" are omitted as appropriate, and the photoconductors 8Y, 8C, 8M, and 8K are referred to as a "photoconductor 8."

The photoconductor 8 is cylindrical-shaped and is connected to a drive motor, not shown. The drive motor generates a driving force to rotate the photoconductor 8. The photoconductor 8 includes an outer surface that includes a photoconductive layer to form an electrostatic latent image thereon.

The photoconductor 8 is surrounded by other image forming components or units, which means that the image forming mechanism 3 further includes such image forming components. Specifically, the image forming components are a charge roller 9, a developing unit 10, a photoconductor cleaning unit 11, a primary transfer roller 12, an intermediate transfer belt 13, a secondary transfer roller 14, and a belt cleaning unit 15.

The charge roller 9, which serves as a charging member, is disposed either in contact with or in proximity to the outer surface of the photoconductor 8. A power source applies a given voltage to the charge roller 9 to cause corona discharge between the charge roller 9 and the photoconductor 8, so that the outer surface or surface of the photoconductor 8 can be charged uniformly.

The optical writing unit 4 emits the laser light beam based on image data to expose the uniformly charged surface of the photoconductor 8, so that the electrostatic latent image based on the image data can be formed on the surface of the photoconductor 8.

The developing unit 10 supplies toner to the photoconductor 8. The toner supplied to the developing unit 10 adheres to the electrostatic latent image formed on the surface of the photoconductor 8 to develop the electrostatic latent image to a single toner image.

The intermediate transfer belt 13, which serves as a transfer member, is loop-shaped and has a base body including resin film or rubber. The intermediate transfer belt 13 is extended by and spanned around a drive roller 16, an inlet roller 17, and a tension roller 18. A drive motor is connected to rotate the drive roller 16. The rotation of the drive roller 16 rotates the intermediate transfer belt 13. The inlet roller 17 and the tension roller 18 rotate by a frictional force caused by the rotation of the intermediate transfer belt 13.

The primary transfer roller 12 is disposed in contact with an inner surface of the intermediate transfer belt 13, which is inside the loop of the intermediate transfer belt 13. By applying a transfer voltage to the primary transfer roller 12, the respective single toner images formed on the photoconductors 8 (or 8Y, 8C, 8M, and 8K) are transferred onto the intermediate transfer belt 13. The respective single toner images on the photoconductors 8 are sequentially overlaid onto the intermediate transfer belt 13 to form a color toner image.

The photoconductor cleaning unit 11 removes residual toner remaining on the surface of the photoconductor 8 after the single toner image is transferred onto the intermediate transfer belt 13. The cleaning process for the photoconductor 8 may remove the residual toner and/or dust remaining on the surface of the photoconductor 8 after the transfer of the single toner image and collect the residual toner as wasted toner.

The color toner image formed on an outer surface of the intermediate transfer belt 13 is conveyed to a transfer position where the intermediate transfer belt 13 and the secondary transfer roller 14 serving as a transfer member contact to each other. In synchronization with a timing that the recording sheet S reaches the transfer position, the given transfer voltage may be applied to the secondary transfer roller 14. By so doing, the color toner image can be transferred from the intermediate transfer belt 13 to the recording sheet S.

The recording sheet S is separated from other recording media in the sheet feeding cassette 5 and fed therefrom. The recording sheet S is then conveyed by a pair of transfer rollers 19 and a pair of registration rollers 20 to the transfer position. After the color toner image is transferred onto the recording sheet S, the recording sheet S may be conveyed to the fixing unit 6.

The fixing unit 6 applies heat and pressure to the recording sheet S with the color toner image thereon. By the application of heat and pressure, the color toner on the image melts to be fixed to the recording sheet S. After the color toner image has been fixed to the recording sheet S, the recording sheet S is conveyed further and discharged to a sheet discharging tray 21 that is formed on a top surface of the main body 2 of the color printer 1.

The belt cleaning unit 15 cleans the outer surface of the intermediate transfer belt 13 after the color toner image is transferred onto the recording sheet S. The cleaning process for the intermediate transfer belt 13 may remove the residual toner and/or dust remaining on the outer surface of the intermediate transfer belt 13 after the transfer of the color toner image and collect the residual toner as wasted toner.

The wasted toner container 7 serves as a reservoir to contain the wasted toner collected by the photoconductor cleaning unit 11 and the belt cleaning unit 15. The wasted toner container 7 may be detachably attached to the main body 2 of the color printer 1. When an amount of wasted toner contained in the wasted toner container 7 is substantially full, the wasted toner container 7 may be replaced with another empty wasted toner container 7.

The photoconductor 8, the charge roller 9, the developing unit 10, and the cleaning unit 11 are components of the image forming mechanism 3. These components can be housed as a unit to form a process cartridge 23 (see FIG. 3) or process cartridges 23Y, 23C, 23M, and 23K (see FIG. 2).

The process cartridge 23 is detachably attached to the main body 2 of the color printer 1. By integrally mounting these components in a unit as the process cartridge 23, a user, a technical representative, and the like can easily perform replacement or maintenance of the components of the image forming mechanism 3 of the color printer 1. Further, relative positions between these components can be precisely maintained, which can enhance quality of images produced by the color printer 1.

In the above-described example, the process cartridge 23 includes the photoconductor 8, the charge roller 9, the developing unit 10, and the photoconductor cleaning unit 11. However, the configuration of the process cartridge 23 is not limited to the above-described configuration. For example, the process cartridge 23 can integrally include the photoconductor 8 and at least one of the charge roller 9, the developing unit 10, and the photoconductor cleaning unit 11 as a unit.

Figure 2:
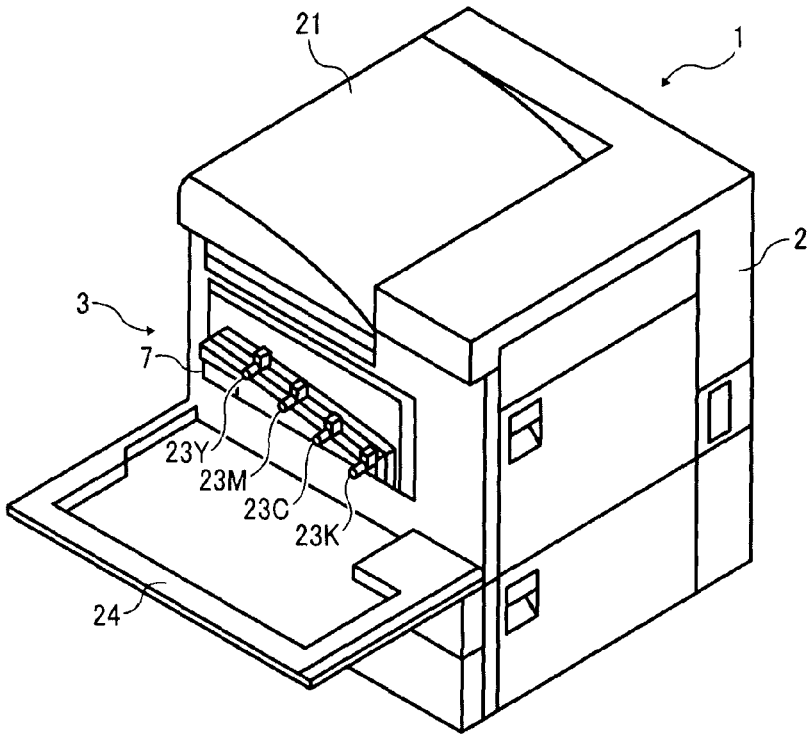
FIG. 2 is a perspective view of the color printer of FIG. 1, with a side cover mounted on a main body case thereof being open.

FIG. 2 is a perspective view of the color printer 1.

The color printer 1 further includes a side cover 24 mounted on the main body 2. The side cover 24 can be opened and closed. When the side cover 24 remains open as shown in FIG. 2, the image forming mechanism 3 and the wasted toner container 7 are exposed, as shown in FIG. 2, so that the process cartridge 23, the intermediate transfer belt 13 (see FIG. 1), and the wasted toner container 7 can easily be replaced or checked for maintenance. Further, the intermediate transfer belt 13, the belt cleaning unit 15, the drive roller 16, the inlet roller 17, and the tension roller 18 may be integrally mounted in a belt case, not shown, as a unit.

Figure 3:
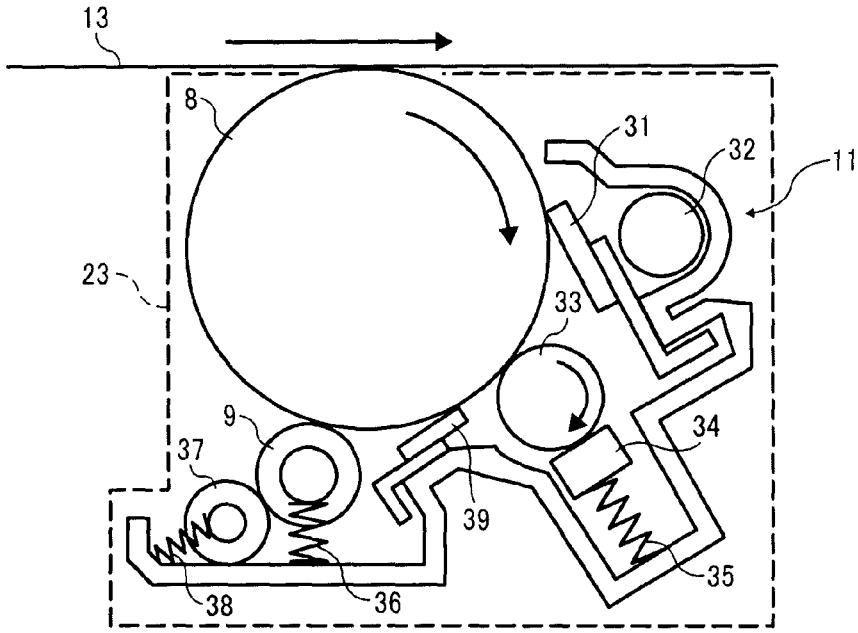
FIG. 3 is a schematic configuration of a process cartridge of the color printer of FIG. 1.

FIG. 3 illustrates a schematic configuration of the process cartridge 23 of the color copier 1 according to an exemplary embodiment of the present invention.

The process cartridge 23 includes the photoconductor 8 and other image forming components arranged around the photoconductor 8. As the image forming components in the process cartridge 23, a waste toner conveying coil 32, a cleaning blade 31, a fur brush 33, a solid lubricant pressing spring 35, an elastic application blade 39, the charge roller 9, a charge roller pressing spring 36, a charge roller cleaner 37, and a charge roller cleaner pressing spring 38 are arranged in this order from an upstream side in a direction of rotation of the photoconductor 8, starting from a point of contact where the intermediate transfer belt 13 and the photoconductor 8 contact to each other.

The cleaning blade 31, which serves as a cleaning member, removes residual toner remaining on the photoconductor 8.

The wasted toner conveying coil 32 conveys the residual toner.

The fur brush 33 scrapes a solid lubricant 34 that is pressed by the solid lubricant pressing spring 35 to adhere lubricant scraped from the solid lubricant 34 to the photoconductor 8.

The elastic application blade 39, which serves as a lubricant fixing member, fixes the lubricant scraped from the solid lubricant 34 to the photoconductor 8.

The charge roller pressing spring 36 presses the charge roller 9 against the surface of the photoconductor 8.

The charge roller cleaner 37, which is pressed by the charge roller cleaner pressing spring 38, cleans the surface of the charge roller 9.

In addition, the developing unit 10 (see FIG. 1) may be provided to the process cartridge 23.

Figure 4:
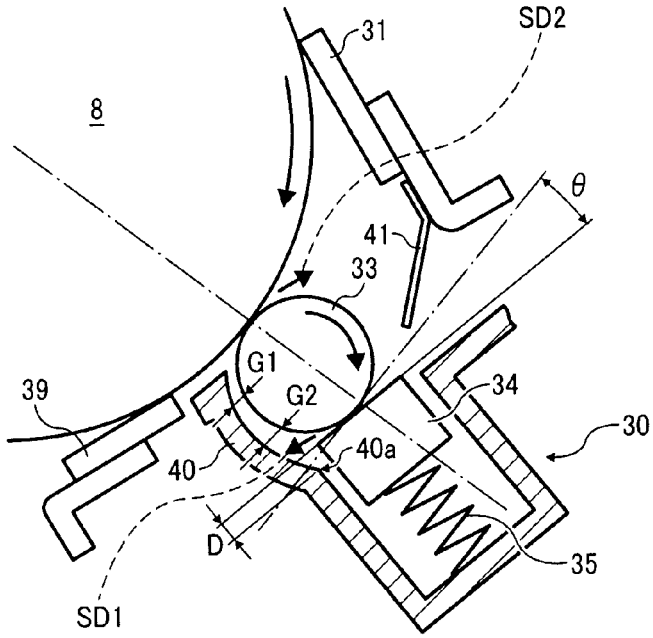
FIG. 4 is a schematic configuration of a lubricant applicator of the color printer of FIG. 1, according to a first exemplary embodiment of the present invention.
Figure 5:
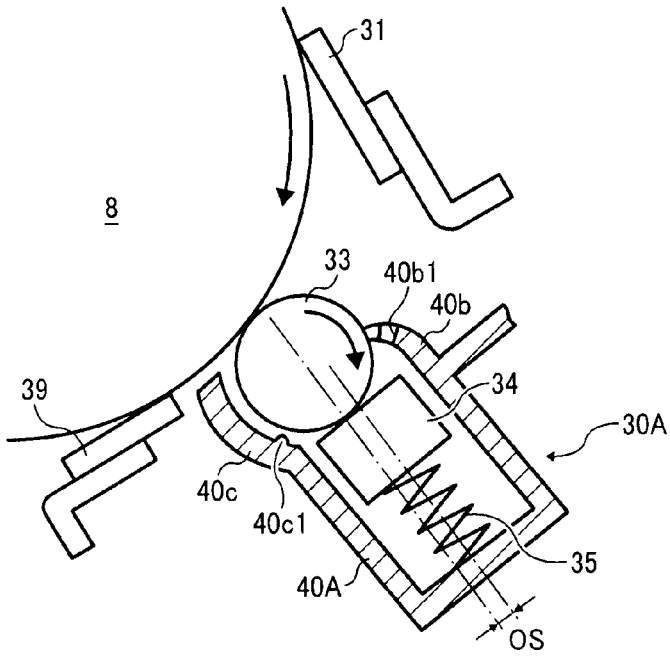
FIG. 5 is a schematic configuration of a lubricant applicator of the color printer of FIG. 1, according to a second exemplary embodiment of the present invention.
Figure 6:
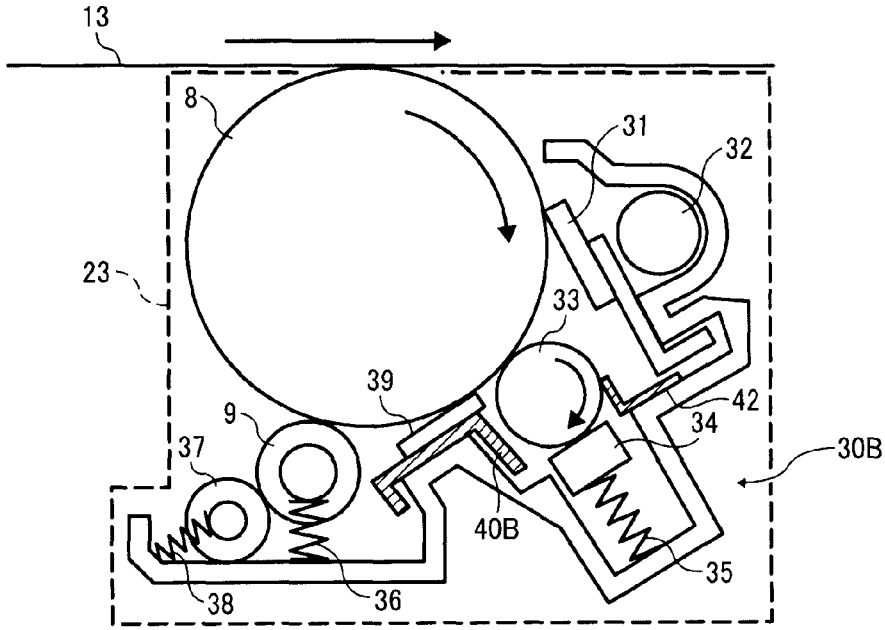
FIG. 6 is a schematic configuration of a lubricant applicator of the color printer of FIG. 1, according to a third exemplary embodiment of the present invention.

FIGS. 4 through 6 illustrate schematic structures of various lubricant applicators of the color printer 1 according to first through third exemplary embodiments of the present patent application.

First Exemplary Embodiment

FIG. 4 shows a schematic configuration of a lubricant applicator 30 according to the first exemplary embodiment.

The lubricant applicator 30 includes the fur brush 33, the solid lubricant 34, the solid lubricant pressing spring 35, and a first guide member 40.

The first guide member 40 is provided between the application blade 39 and the fur brush 33 to effectively convey the lubricant scraped from the solid lubricant 34 to the surface of the photoconductor 8.

The fur brush 33 rotates in the direction of rotation of the photoconductor 8, and the elastic application blade 39 is held in contact with the surface of the photoconductor 8 in a counter manner or against the surface of the photoconductor 8. When compared with a blade arranged in a trailing manner, the elastic application blade 39 that is arranged in the counter manner with respect to the rotation of the photoconductor 8 can set a contact pressure to a low level, which can prevent or reduce loss of resilience and abrasion of the elastic application blade 39. The prevention of loss of resilience and abrasion of the elastic application blade 39 can maintain the stable performance of the elastic application blade 39 for a long period of time.

While scraping the solid lubricant 34 disposed in the lubricant applicator 30, the fur brush 33 that is held in contact with the solid lubricant 34 conveys the scraped lubricating powder to the photoconductor 8.

Generally, when the fur brush 33 scrapes the solid lubricant 34, the scraped lubricant in a powder form or lubricating powder may scatter therearound due to the rotation of the fur brush 33. Specifically, a part of the scraped lubricating powder attached to the fur brush 33 may fly and scatter in a lubricant scattering direction SD1 as shown in FIG. 4.

The lubricant applicator 30 is designed to apply the lubricating powder to the surface of the photoconductor 8. Specifically, the fur brush 33 rotates in the direction of rotation of the photoconductor 8. The first guide member 40 is disposed between the elastic application blade 39 and the fur brush 33 so as to extend one end of the first guide member 40 close to a point of contact between the application blade 39 and the photoconductor 8. By so doing, an excess amount of the solid lubricant may not be spent unnecessarily but can adhere to the surface of the photoconductor 8 so as to be fixed by the elastic application blade 39. Therefore, the transferability of the lubricant can be enhanced, which can increase the amount of application of the lubricant onto the photoconductor 8. Further, when an appropriate amount of the lubricating powder scraped from the solid lubricant 34 by the fur brush 33 is conveyed to the photoconductor 8 and the lubricating powder is fixed to the surface of the photoconductor 8, the efficiency of application of the lubricant scraped from the solid lubricant 34 can be increased. According to the increase of the efficiency of application of the lubricant, an amount of consumption of the solid lubricant 34 can be reduced, thereby maintaining a stable quality of the solid lubricant 34 for a long period of time.

As previously described, the first guide member 40 is disposed between the fur brush 33 and the application blade 39. The first guide member 40 includes a corner 40*a* arranged at one end of a circular-arc-shaped part thereof, or a starting point of a curved portion thereof, formed on a back side of the first guide member 40. The corner 40*a* is disposed so that the corner 40*a* may be arranged farther than a point of contact between the solid lubricant 34 and the fur brush 33 from the surface of the photoconductor 8 (in other words, a distance between the starting point of the curved portion of the first guide member and the surface of the image carrier is greater than a distance between a point of contact between the solid lubricant and the fur brush and the surface of the image carrier) and a gap formed between an inner surface of the circular-arc-shaped part or a curved inner surface of the first guide member 40 and the fur brush 33 may become narrower as the circular-arc-shaped part of the first guide member 40 extends toward the surface of the photoconductor 8.

In this case, it is preferable that the corner 40*a* of the first guide member 40 is located at a position having a gap ranging between 1 mm and 3 mm from a contact surface where the fur brush 33 and the solid lubricant 34 contact each other, in a direction opposite to the photoconductor 8. In other words, it is preferable that a distance of a gap between the contact surface of the fur brush 33 and the solid lubricant 34 and the corner 40*a* of the first guide member 40 ranges from 1 mm to 3 mm. Such gap can help convey the scattered lubricating powder to the first guide member 40, even the lubricating powder scraped from the solid lubricant 34 scatters when the fur brush 33 in rotation separates from the solid lubricant 34. Thus, the lubricating powder scraped from the solid lubricant 34 can be effectively conveyed to the first guide member 40, and therefore the transferability of the lubricant can increase to enhance the efficiency of application of the solid lubricant 34.

Further as described above, as the first guide member 40 extends closer to the photoconductor 8, the gap between the curved inner surface of the first guide member 40 and the fur brush 33 becomes narrower, as indicated by a gap G1 and a gap G2 in FIG. 4. With the configuration, the elastic application blade 39 can be disposed closer to the fur brush 33. As a result, the size of the overall color printer 1 can be reduced.

When the gap between the fur brush 33 and the curved inner surface of the first guide member 40 is either below 1 mm or above 3 mm, an amount of lubricating powder scraped from the solid lubricant 34 but not conveyed to the first guide member 40 has tend to increase.

As shown in FIG. 4, the gap between the curved inner surface of the first guide member 40 and the fur brush 33 is formed to be smaller or narrower as the first guide member 40 extends to the photoconductor 8. By forming such gap between the first guide member 40 and the fur brush 33, the lubricating powder that is scraped from the solid lubricant 34 but scattered in the gap can be caught and held by the fur brush 33 and be applied to the surface of the photoconductor 8.

As shown in FIG. 4, the cross section of the solid lubricant 34 is square-shaped and has four lines indicating surfaces, one of which is in contact with the fur brush 33. A specific line indicating a contact surface of the solid lubricant 34 contacting the fur brush 33 is disposed so as to intersect a line perpendicular to a straight line connecting an axial center of the photoconductor 8, an axial center of the fur brush 33, and a point of contact where the fur brush 33 and the solid lubricant 34 contact each other. The contact surface of the solid lubricant 34 is held in contact with the fur brush 33 at an angle θ ranging from 1 degree to 90 degrees in a direction of rotation of the photoconductor 8. By so doing, the lubricating powder that scatters when the fur brush 33 in rotation separates from the solid lubricant 34 can be conveyed in a direction toward the first guide member 40 without spending an excess amount of the solid lubricant 34. This transfer of the lubricating powder to the curved inner surface of the first guide member 40 can enhance the transferability of the lubricating powder, which can result in an increase of the efficiency of application of the lubricant. When the solid lubricant 34 is disposed at an angle θ of either below 0 degree or above 90 degrees with respect to the fur brush 33, an amount of lubricating powder scraped from the solid lubricant 34 but not conveyed to the first guide member 40 has tend to increase.

Further as shown in FIG. 4, after the fur brush 33 contacts the photoconductor 8, the lubricating powder remaining on the fur brush 33 may scatter from the fur brush 33 in a direction SD2 due to a centrifugal force or the like of the fur brush 33. That is, the lubricating powder may scatter from the fur brush 33 to the direction SD1 or a downstream side from where the fur brush 33 contacts the solid lubricant 34 in the direction of rotation of the fur brush 33 and to the direction SD2 or a downstream side from where the fur brush 33 contacts the photoconductor 8 in the direction of rotation of the fur brush 33.

To effectively apply the lubricating powder scattered from the fur brush 33 to the surface of the photoconductor 8, the lubricating powder scattered from the solid lubricant 34 in the direction SD1 is received by the first guide member 40 and the lubricating powder separated from the photoconductor 8 in the direction SD2 is received by a second guide member 41, which is a sheet-shaped member disposed between the cleaning blade 31 and the fur brush 33. With the above-described configuration, the solid lubricant 34 can be used without unnecessarily spending the excess amount thereof, thereby enhancing the efficiency of application of the lubricant to the photoconductor 8. Thus, when the fur brush 33 in rotation separates from the solid lubricant 34, the scattering lubricating powder scraped by the fur brush 33 can be conveyed to the photoconductor 8 effectively. This action can enhance the transferability of the solid lubricant 34 and the efficiency of application of the lubricant to the photoconductor 8. Accordingly, the amount of consumption of the solid lubricant 34 can be reduced to maintain the stable performance of the solid lubricant 34 for a long period of time.

Further, the cleaning blade 31 and the elastic application blade 39 respectively are coated by a resin having a low surface frictional coefficient, such as fluorine contained resin and silicone resin, so as to reduce abrasion of the cleaning blade 31 and the elastic application blade 39 and to maintain stable performance of the cleaning blade 31 and the elastic application blade 39.

Further, by coating metallic compound such as carbide including C, TiC, etc., and nitride including AIN, TiN, etc., the surface of the cleaning blade 31 can become rigid to reduce the degree of abrasion, and therefore the cleaning blade 31 can provide consistent performance for a long period of time. By so doing, durability of the cleaning blade 31 may enhance, which can reduce the running cost of the color printer 1.

Second Exemplary Embodiment

FIG. 5 illustrates a schematic structure of a lubricant applicator 30A according to a second exemplary embodiment of the present invention.

Elements or components of the lubricant applicator 30A of FIG. 5 may be denoted by the same reference numerals as those of the lubricant applicator 30 of FIG. 4 according to the first exemplary embodiment and the descriptions thereof are omitted or summarized.

A first guide member 40A includes a curved portion 40*c* that is circular-arc-shaped in a cross section thereof and is concentric with the fur brush 33. The first guide member 40A has an inner surface facing the fur brush 33 and a gap therebetween is 1 mm or smaller.

However, the first guide member 40A may not necessarily be concentric with the fur brush 33. When the first guide member 40A is not concentric with the fur brush 33, the minimum distance of the gap between the fur brush 33 and the first guide member 40A preferably ranges 1 mm or smaller.

With this gap, the lubricating powder may be preferably yielded to be returned to the fur brush 33, so that the accumulated lubricating powder can be conveyed to a point of contact where the elastic application blade 39 and the photoconductor 8 contact each other. As a result, the lubricating powder scraped from the solid lubricant 34 can be stably conveyed to the photoconductor 8.

In addition, it is preferable that multiple protrusions 40*c*1 or grooves along the inner surface of the arc 40*c*. When the lubricating powder falls from the fur brush 33 to the inner surface of the arc 40*c*, the multiple protrusions 40*c*1 or grooves may catch and hold the lubricating powder. Thus, the lubricating powder can be caught and held by the first guide member 40A to be accumulated easily.

The cross section of the solid lubricant 34 is square-shaped and has four surfaces, one of which is a contact surface contacting the fur brush 33. A line that starts from a center of rotation of the fur brush 33 extends to a point of contact where the fur brush 33 and the solid lubricant 34 contact each other and intersects a line perpendicular to the contact surface of the solid lubricant 34 contacting the fur brush 33. With respect to the above-described line, a center in a width direction of the one line of the solid lubricant 34 is offset in an upstream direction in the direction of rotation of the fur brush 33 by approximately 1 mm to approximately 2 mm, indicated as "OS" in FIG. 5. With this configuration, the rotation of the fur brush 33 can reduce a force to move the solid lubricant 34 to a downstream side in the direction of rotation of the fur brush 33, and therefore a pressure of the solid lubricant 34 to the fur brush 33 can be stabilized. Accordingly, the solid lubricant 34 to be scraped by the fur brush 33 can be stabilized.

Further, in the second exemplary embodiment, the lubricant applicator 40A includes a flicking member 40*b* that serves as a powder collector. The flicking member 40*b* is disposed upstream from a point of contact between the fur brush 33 and the solid lubricant 34 to remove the lubricating powder and toner from the fur brush 33 before the lubricating powder and toner reach the point of contact therebetween.

The flicking member 40*b* includes multiple through holes 40*b*1 at equal intervals in a longitudinal or axial direction of the fur brush 33. The particles of the lubricating powder and toner falling from the fur brush 33 are accumulated on an outer surface or top of the flicking member 40*b* and pass through the multiple through holes 40*b*1 to be also accumulated in a portion between the solid lubricant pressing spring 35 in the first guide member 40A and the solid lubricant 34. By providing the flicking member 40*b* in the lubricant applicator 40A, a rate of the lubricant in materials stored in the gap between the arc 40*c* of the first guide member 40A and the fur brush 33, which can increase the efficiency of application of the lubricant to the photoconductor 8.

Further, since the elastic application blade 39 is coated, the durability of the elastic application blade 39 can be enhanced. By so doing, the durability of the image forming mechanism 3 may enhance, which can reduce the running cost of the color printer 1.

Third Exemplary Embodiment

FIG. 6 illustrates a schematic structure of a lubricant applicator 30B according to a third exemplary embodiment of the present invention.

Elements or components of the lubricant applicator 30B of FIG. 6 according to the third exemplary embodiment may be denoted by the same reference numerals as those of the lubricant applicator 30 of FIG. 4 according to the first exemplary embodiment and the descriptions thereof are omitted or summarized.

The lubricant applicator 30B includes a first guide member 40B that is U-shaped in its cross section and includes a metal plated member to hold the elastic application blade 39. By holding the elastic application blade 39 with the first guide member 40B as shown in FIG. 6, a shape of a frame to attach the first guide member 40B can be simpler.

Further, the one end of the first guide member can be arranged closer to the point of contact between of the elastic application blade 39 and the photoconductor 8. Therefore, the lubricating powder scraped from the solid lubricant 34 by the fur brush 33 can be effectively conveyed and fixed to the surface of the photoconductor 8, thereby enhancing the efficiency of application of the lubricant. When the efficiency of application of the lubricant increases, the consumption amount of the solid lubricant 34 can be reduced.

When the color printer 1 having the configuration of the lubricant applicator 30B according to the third exemplary embodiment completes the printing operation, the drive motor of the photoconductor 8 stops. Then, the drive motor causes the photoconductor 8 to rotate in a direction opposite to the direction of rotation of the photoconductor 8 by less than one cycle. Accordingly, the cleaning blade 31 and the elastic application blade 39 may not cause curling, and the durability of the color printer 1 may enhance.

In the third exemplary embodiment, the lubricant applicator 30B further includes a flicking member 42. Similar to the flicking member 40*b*, the flicking member 42 collects the lubricant powder and the toner from the fur brush 33 before the lubricant powder and the toner reach the point of contact of the fur brush 33 and the solid lubricant 34. In addition to the above-described function, the flicking member 42 that is held in contact with the solid lubricant 34 limits a movement of the solid lubricant 34 in the contact direction. This action may reduce a change in position of the solid lubricant 34 caused by a direct and reverse rotation of the fur brush 33. A stable posture of the solid lubricant 34 can reduce a scraped amount of the solid lubricant 34, and therefore a consistent amount of lubricating powder scraped from the solid lubricant 34 can be supplied to the photoconductor 8.

Fourth Exemplary Embodiment

Figure 7:
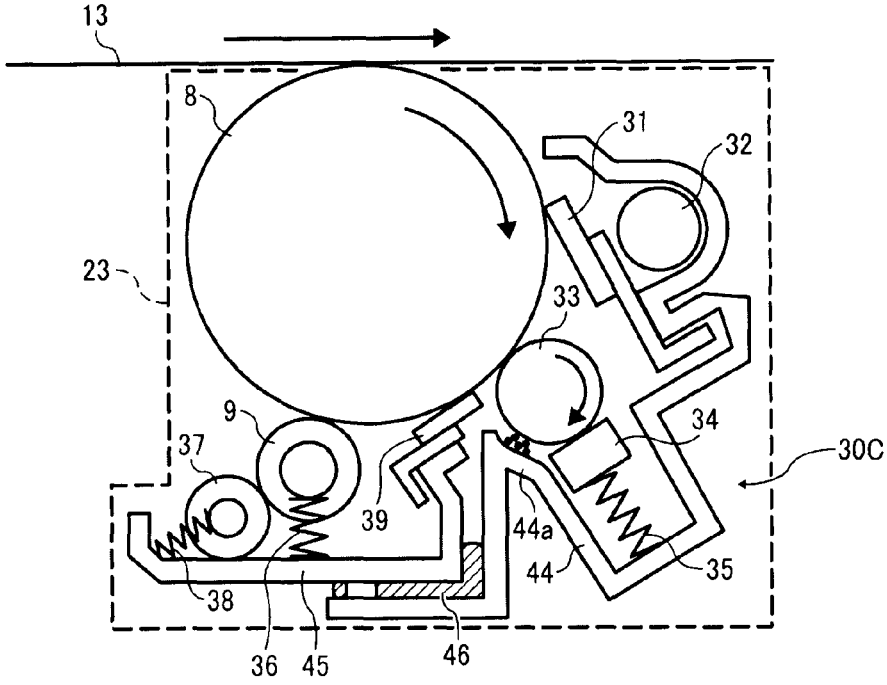
FIG. 7 is a schematic configuration of a lubricant applicator of the color printer of FIG. 1, according to a fourth exemplary embodiment of the present invention.

FIG. 7 illustrates a schematic structure of a lubricant applicator 30C according to a fourth exemplary embodiment of the present invention.

Elements or components of the lubricant applicator 30C of FIG. 7 according to the fourth exemplary embodiment may be denoted by the same reference numerals as those of the lubricant applicators 30 through 30B of FIGS. 4 through 6 according to the first through third exemplary embodiments and the descriptions thereof are omitted or summarized.

In the fourth exemplary embodiment of the present invention, the lubricant applicator 30C includes a first frame 44 and a second frame 45.

The first frame 44 holds or supports the photoconductor 8, the cleaning blade 31, the wasted toner conveying coil 32, the solid lubricant 34, the fur brush 33, and the solid lubricant pressing spring 35. The first frame 44 includes a guide part 44*a* to hold the lubricant that cannot be carried or conveyed by the fur brush 33. Details of the guide part 44*a* will be described later.

The second frame 45 holds or supports the elastic application blade 39, the charge roller 9, the charge roller pressing spring 36, the charge roller cleaner 37, and the charge roller cleaner pressing spring 38.

As described above, when the cleaning blade 31 and the elastic application blade 39, both of which can be vibration sources due to friction-sliding against the photoconductor 8, are fixed respectively to different frames, these vibrations may be less transmitted via the frames to the cleaning blade 31 and the elastic application blade 39. Accordingly, amplification and resonance of the vibration can be further reduced.

Further, the cleaning blade 31 is held by the first frame 44 and the elastic application blade 39 is held by the second frame 45. Respective mold-parting directions of the first frame 44 and the second frame 45 can be more free from limitation when compared with a mold-parting direction of a single frame of the first and second frames 44 and 45 for holding the cleaning blade 31 and the application blade 39 on a same frame. By holding the cleaning blade 31 and the elastic application blade 39 on different frames, rigidities of the first frame 44 and the second frame 45 can be increased. Accordingly, amplification of the vibrations and resonance thereof related to the cleaning blade 31, the application blade 39, the first frame 44, the second frame 45, the photoconductor 8, a blade holder (not shown) and the like can be further reduced, and defective images and noises caused by the vibrations can be also reduced.

As shown in FIG. 7, the effect can be achieved but is not limited to the condition where the cleaning blade 31 and a blade other than the elastic application blade 39 are used. For example, the same effect can be achieved when the elastic application blade 39 is replaced by an abrasive or polishing blade that removes foreign materials adhering to the surface of the photoconductor 8.

Further, in the fourth exemplary embodiment, the elastic application blade 39 is held in contact with the photoconductor 8 in a counter manner in the direction of rotation of the photoconductor 8. By contacting the elastic application blade 39 to the photoconductor 8 in a counter manner or against the direction of rotation of the photoconductor 8, the contact pressure of the elastic application blade 39 can be more reduced compared when the elastic application blade 39 is arranged in a trailing manner, so that sag and abrasion of the elastic application blade 39 can be prevented so that the consistent performance of the elastic application blade 39 can be maintained for a long period of time.

Further, in the fourth exemplary embodiment of the present invention, the first frame 44 that holds the cleaning blade 31 supports the photoconductor 8 and the second frame 45 is fixed to the first frame 44. With this structure, the cleaning blade 31 and the photoconductor 8 can be positioned with accuracy, and therefore the constant cleaning condition of the elastic application blade 39 can be maintained and the cleaning performance of the elastic application blade 39 can be stabilized.

Further, when it is not necessary that any blade other than the cleaning blade 31 is positioned to the photoconductor 8 more accurately than the cleaning blade 31, the blade may be positioned via the first frame 44. By so doing, the configuration of the lubricant applicator 30C can be simpler and the assembly of the lubricant applicator 30C can be enhanced. Therefore, the stability of cleaning performance, the simpler configuration, and enhancement of the assembly can be achieved.

Further, in the fourth exemplary embodiment, a vibration-proof member 46 is provided between the first frame 44 and the second frame 45 so as to prevent vibration transmission between the first frame 44 and the second frame 45 and increase vibration suppression. Accordingly, amplification of the vibration and resonance of the vibration can be further reduced.

Figure 8:
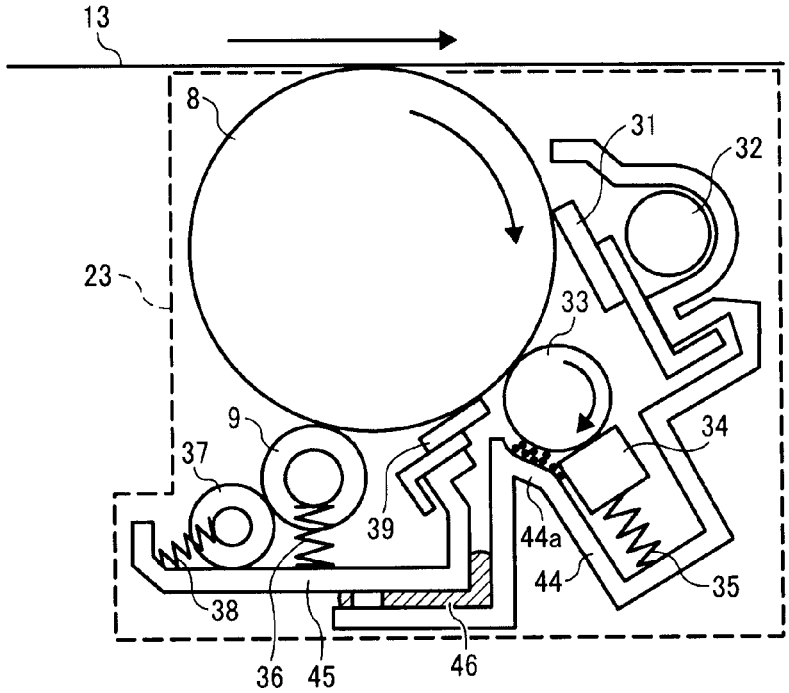
FIG. 8 is a schematic configuration of the lubricant applicator of FIG. 7, with a guide part provided thereto.
Figure 9:
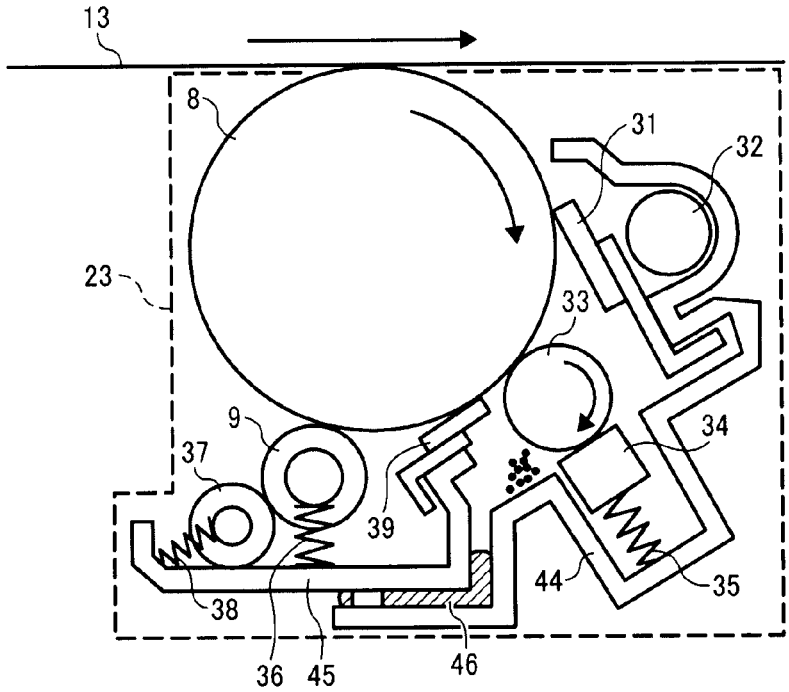
FIG. 9 is a schematic configuration of an example lubricant applicator without the guide part of FIG. 8.

Referring to FIGS. 8 and 9, descriptions are given of the schematic structure of the first frame 44.

In FIG. 8, the first frame 44 includes the guide part 44*a* to hold the lubricating powder that cannot be carried by the fur brush 33. When the fur brush 33 scrapes the solid lubricant 34, some amount of lubricant powder falls from the fur brush 33. The guide part 44*a* catches and holds the lubricating powder fell from the fur brush 33, so that the lubricating powder can adhere to the fur brush 33. Therefore, the unnecessary consumption amount of the lubricating powder scraped from the solid lubricant 34 can be reduced, and the lubricant can be supplied to the photoconductor 8 effectively.

By contrast, when the first frame 44 does not include the guide part 44*a*, the structure of which shown in FIG. 9, the lubricating powder that cannot be held or carried by the fur brush 33 may be discarded, and therefore the amount of lubricating powder to be supplied to the photoconductor 8 may be reduced significantly.

Figure 10:
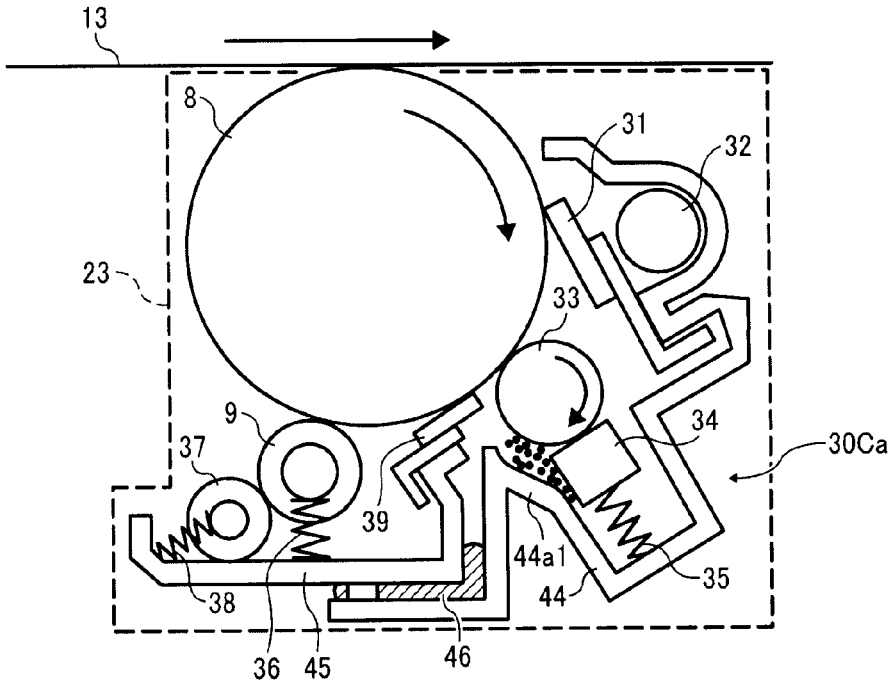
FIG. 10 is a schematic configuration of a modified lubricant applicator with a modified guide part.

FIG. 10 shows a schematic configuration of a modified lubricant applicator 30Ca having a modified guide part 44*a*1. The modified guide part 44*a*1 is provided to have a greater gap with respect to the fur brush 33. Specifically, the gap between the guide part 44*a*1 and the fur brush 33 is greater than the gap between the guide part 44*a* and the fur brush 33 of FIG. 8. The above-described structure can reduce the amount of lubricating powder that is accumulated on the guide part 44*a* to adhere again to the fur brush 33, and therefore the amount of lubricating powder to be less supplied to the photoconductor 8 can be reduced.

Figure 11:
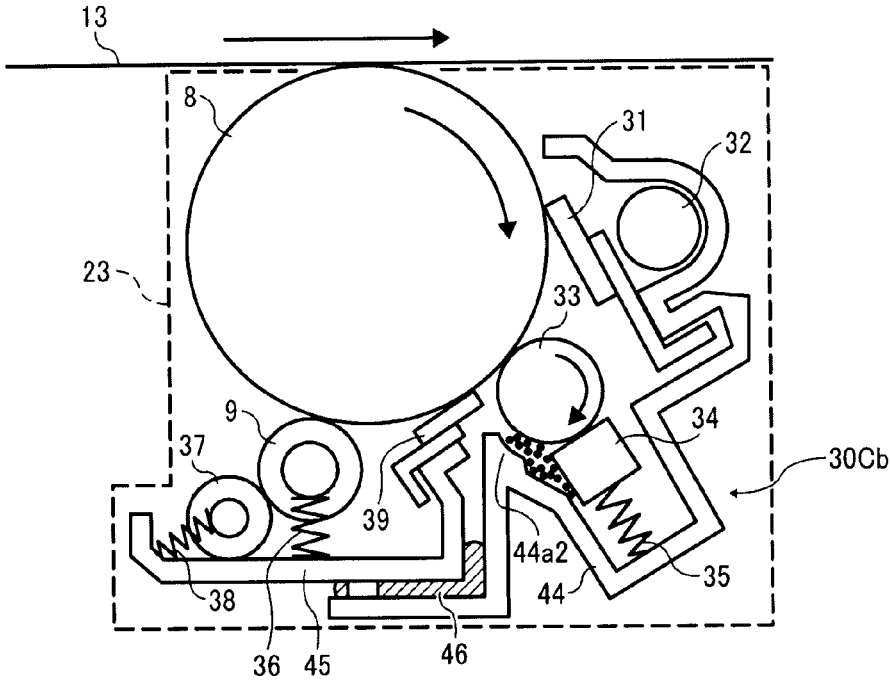
FIG. 11 is a schematic configuration of another modified lubricant applicator with another modified guide part.

FIG. 11 shows a schematic configuration of another modified lubricant applicator 30Cb having another modified guide part 44*a*2. The modified guide part 44*a*2 is provided to have a smaller length of an arc portion thereof. Specifically, the length of the arc portion of the guide part 44*a*2 is reduced or is smaller than the length of the arc portion of the guide part 44*a* of FIG. 8. The above-described structure can reduce the amount of lubricating powder that is accumulated on the guide part 44*a* to adhere again to the fur brush 33, and therefore the amount of lubricating to be supplied to the photoconductor 8 can be reduced.

Further, it is more preferable that a guide having a combination of the guide part 44*a*1 of FIG. 10 and the guide part 44*a*2 of FIG. 11 is provided so that the amount of lubricating powder to be supplied to the photoconductor 8 can be further reduced.

The distance of the gap between the guide part 44*a* and the fur brush 33 may be preferably changed at various positions in a longitudinal or axial direction of the first guide member 40. The above-described structure of the first guide member 40 can vary (increase and decrease) the amount of lubricating powder to be supplied to the photoconductor 8 in the longitudinal or axial direction of the guide part 44*a*, and perform finer adjustment of the lubricating powder.

For example, when the cleaning performance is poorer at end portions of the photoconductor 8 than at a center portion thereof, the arc part of the guide part 44*a* can be extended or formed longer at a position approximately 20 mm away from the end portion than the center portion thereof. With the above-described structure, the amount of lubricating powder to be supplied to the end portion of the photoconductor 8 can increase. The increase of the amount of lubricating powder can ensure a better cleaning performance over the longitudinal direction of the guide part 44*a*, and can obtain a configuration of the photoconductor 8 and its peripherals, with higher confidence, longer life, and higher quality.

Figure 12:
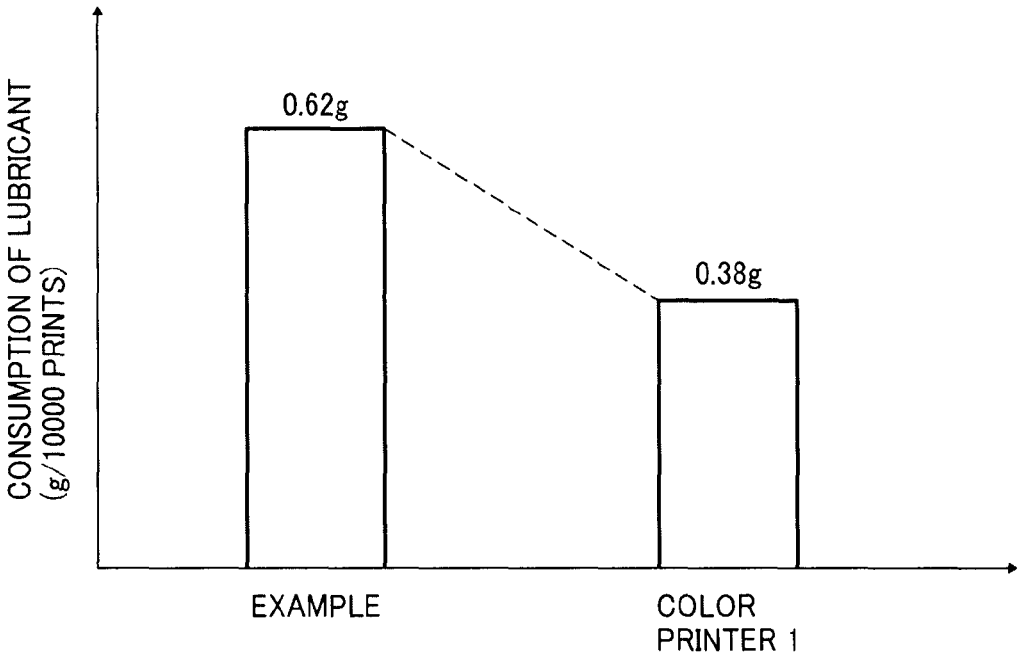
FIG. 12 is a graph showing results of comparison of the present invention and an example regarding consumption of lubricant.

FIG. 12 illustrates a graph showing results of tests conducted to show the effects of the prevent invention. The color printer 1 having the configuration according to the first exemplary embodiment (indicated as "COLOR PRINTER 1" in FIG. 12) printed 10,000 copies, and the consumption amount of lubricant used for the color printer 1 was compared with the consumption amount of lubricant used for a conventional image forming apparatus as an example (indicated as "EXAMPLE" in FIG. 12). At this time, the copies were printed while adjusting a pressing force of the solid lubricant pressing spring 35 so as not to cause defective images due to contamination of the charge roller 9 and due to filming of the lubricating powder on the surface of the photoconductor 8. Since process conditions such as the size of the photoconductor 8, the print mode, and the speed of rotation of the photoconductor 8 were same and the sample images were same, these consumption amounts of lubricant can be relatively compared.

According to the results shown in FIG. 12, the consumption amount of lubricant in the color printer 1 that includes the lubricant applicator 30 having the first guide member 40 is significantly smaller than the consumption amount of lubricant in the conventional image forming apparatus. Therefore, the present invention can enhance the efficiency of application of the lubricating powder and reduce the consumption amount of the solid lubricant 34. By reducing the consumption amount of the solid lubricant 34, the performance of the solid lubricant 34 can be maintained longer than the conventional image forming apparatus.

The above-described effect can be also achieved when tests were conducted with the cleaning unit 15 and the process cartridge 23 including the lubricant applicator 30 (30A, 30B, 30C, 30Ca, and 30Cb). By enhancing the efficiency of application of the lubricating powder and reducing the abrasion of the cleaning blade 31 and the elastic application blade 39, the process cartridge 23 that can maintain the stable performance thereof for a long period of time can be provided. Further, the same effect can be achieved when the tests were conducted with the color printer 1 according to the second through fourth exemplary embodiments of the present invention.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present patent application, and all such modifications as would be obvious to one skilled in the art are intended to be included within the scope of the following claims.

What is claimed is:

1. A lubricant applicator, comprising:

a fur brush disposed downstream from a cleaning member in a direction of rotation of an image carrier and configured to move in the direction of rotation of the image carrier, the fur brush scraping a solid lubricant disposed opposite to the image carrier as the fur brush rotates and applying powder scraped from the solid lubricant to the surface of the image carrier;

a lubricant fixing member configured to fix the powder to the surface of the image carrier; and a guide member disposed between the lubricant fixing member and the fur brush and configured to convey the powder scattered from the fur brush to the surface of the image carrier, wherein the guide member is disposed substantially below the fur brush.

2. The lubricant applicator according to claim 1, wherein the lubricant fixing member includes an elastic blade configured to contact the image carrier against to the direction of rotation of the image carrier.

3. The lubricant applicator according to claim 1, wherein one side of the guide member has a curved portion having a circular-arc cross-section, an inner surface of the curved portion of the guide member faces a surface of the fur brush, a distance between a starting point of the curved portion of the guide member and the surface of the image carrier is greater than a distance between a point of contact between the solid lubricant and the fur brush and the surface of the image carrier, and a gap formed between the inner surface of the curved portion of the guide member and the surface of the fur brush becomes narrower as the curved portion of the first guide member extends toward the image carrier.

4. The lubricant applicator according to claim 1, wherein the solid lubricant has a square-shaped cross-section with four surfaces, one of which being a contact surface contacting the fur brush, and the contact surface is disposed so as to intersect a line perpendicular to a line connecting an axial center of the image carrier, an axial center of the fur brush, and a point of contact between the solid lubricant and the fur brush at an angle ranging from 1 degree to 90 degrees in the direction of rotation of the image carrier.

5. The lubricant applicator according to claim 1, further comprising an additional guide member disposed between the cleaning member and the fur brush to return the powder scattered from the fur brush to the fur brush.

6. The lubricant applicator according to claim 1, wherein the lubricant fixing member includes a coated blade.

7. The lubricant applicator according to claim 1, wherein the guide member has a curved portion having a circular-arc cross-section, the curved portion of the first guide member is concentric with the fur brush, and a gap formed between an inner surface of the curved portion of the guide member and the fur brush is equal to or smaller than 1 mm.

8. The lubricant applicator according to claim 7, wherein the guide member having the circular-arc cross-section includes either a protrusion or a groove along the curved inner surface thereof.

9. The lubricant applicator according to claim 1, wherein the guide member has a curved portion having a circular-arc cross-section, a minimum distance of a gap formed between an inner surface of the curved portion of the guide member and the fur brush being no greater than 1 mm.

10. The lubricant applicator according to claim 1, wherein the solid lubricant has a square-shaped cross-section with four surfaces, one of the surfaces being a contact surface contacting the fur brush, and a center in a width direction of the contact surface is offset to an upstream side of the direction of rotation of the fur brush from a line starting from a center of rotation of the fur brush and extending perpendicular to the contact surface.

11. The lubricant applicator according to claim 1, further comprising a powder collector configured to collect, from the fur brush, toner removed from the surface of the image carrier before the toner reaches a point of contact between the fur brush and the solid lubricant.

12. The lubricant applicator according to claim 11, wherein the powder collector contacts the solid lubricant to restrain movement of the solid lubricant in a contact direction.

13. The lubricant applicator according to claim 1, wherein the guide member includes a plating member holding an elastic blade.

14. The lubricant applicator according to claim 1, wherein an inner surface of the guide member and the fur brush form a gap having different distances in a longitudinal direction of the first guide member.

15. The lubricant applicator according to claim 14, wherein the guide member has a curved portion having a circular-arc cross-section and the curved portion of the guide member is concentric with the fur brush, and a gap formed between the inner surface of the curved portion of the guide member and the fur brush is equal to or smaller than 1 mm.

16. The lubricant applicator according to claim 14, wherein the guide member has a curved portion having a circular-arc cross-section, a minimum distance of the gap formed between the inner surface of the curved portion of the guide member and the fur brush being no greater than 1 mm.

17. A cleaning unit, comprising:

a cleaning member configured to remove residual toner from a surface of an image carrier after a toner image is transferred from the image carrier; and the lubricant applicator of claim 1.

18. The cleaning unit according to claim 17, wherein the image carrier is rotated by a drive motor in a given direction during a printing operation, the drive motor causing the image carrier to rotate less than one cycle of rotation in a direction opposite to the given direction to prevent curling of the cleaning member and the lubricant fixing member after completion of the printing operation and halting of the drive motor.

19. A process cartridge detachably attached to an image forming apparatus, the process cartridge comprising:

an image carrier configured to carry an image on a surface thereof; and a lubricant applicator integrally attached thereto with the image carrier, the lubricant applicator comprising:

a fur brush disposed downstream from a cleaning member in a direction of rotation of the image carrier and configured to move in the direction of rotation of the image carrier, the fur brush scraping a solid lubricant disposed opposite to the image carrier as the fur brush rotates and applying powder scraped from the solid lubricant to the surface of the image carrier;

a lubricant fixing member configured to fix the powder to the surface of the image carrier; and a guide member disposed between the lubricant fixing member and the fur brush and configured to convey the powder scattered from the fur brush to the surface of the image carrier, wherein the guide member is disposed substantially below the fur brush.

20. An image forming apparatus, comprising:

an image carrier configured to carry an image on a surface thereof;

a developing unit configured to develop the image to a toner image;

a transfer unit configured to transfer the toner image onto a recording medium directly or via an intermediate transfer member;

a cleaning unit including a cleaning member configured to remove residual toner from the surface of the image carrier after the toner image is transferred from the image carrier to the intermediate transfer member; and a lubricant applicator comprising:

a fur brush disposed downstream from the cleaning member in a direction of rotation of the image carrier and configured to move in the direction of rotation of the image carrier, the fur brush scraping a solid lubricant disposed opposite to the image carrier as the fur brush rotates and applying powder scraped from the solid lubricant to the surface of the image carrier;

a lubricant fixing member configured to fix the powder to the surface of the image carrier; and a guide member disposed between the lubricant fixing member and the fur brush and configured to convey the powder scattered from the fur brush to the surface of the image carrier, wherein the guide member is disposed substantially below the fur brush.

* * * * *